US007009097B1

(12) United States Patent
Terplivetz

(10) Patent No.: US 7,009,097 B1
(45) Date of Patent: Mar. 7, 2006

(54) GUITAR STRAP

(76) Inventor: Dorrise S. Terplivetz, 8133 Woodsworth Dr., Orlando, FL (US) 32817

( * ) Notice: Subject to any disclaimer, the term of this patent is extended or adjusted under 35 U.S.C. 154(b) by 29 days.

(21) Appl. No.: 10/839,014

(22) Filed: May 6, 2004

(51) Int. Cl.
*G10D 3/00* (2006.01)

(52) U.S. Cl. ..... 84/327; 84/329

(58) Field of Classification Search ..... 84/327, 84/329, 453, 290
See application file for complete search history.

(56) References Cited

U.S. PATENT DOCUMENTS 1,631,694 A * 6/1927 Rick ..... 224/264
3,102,446 A * 9/1963 Raleigh ..... 84/327
5,000,071 A 3/1991 Thomas
5,069,103 A 12/1991 Healy
5,191,160 A 3/1993 Barnett
5,493,941 A 2/1996 Verge
5,616,874 A 4/1997 Kraus et al.
5,817,961 A * 10/1998 Beck ..... 84/327

* cited by examiner

*Primary Examiner*—Kimberly Lockett

(57) ABSTRACT

An apparatus securable about a waist of an operator and for supporting a guitar at select positions includes a belt and a pair of selectively engageable end portions extending substantially parallel thereto. The belt further has a central portion integral with the opposed end portions and is disposed substantially medially of an abdominal area of an operator. The apparatus further includes a plurality of adjustable support members secured to the central portion. The plurality of support members include a plurality of hook sections connected thereto for receiving select portions of a guitar to thereby allow a user to maintain a guitar at a substantially stable position during operating conditions while relieving pressure from a user's back and shoulders.

14 Claims, 2 Drawing Sheets

GUITAR STRAP

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a guitar strap and, more particularly, to a waist worn guitar strap to relieve neck and back pain.

2. Prior Art

Stringed instruments such as banjos, ukuleles, mandolins, guitars and the like are often played while the performer is standing and holding the instrument in front of their body. For most of these instruments, just positioning and holding the instrument in front of the body during performance is sufficient throughout the entire performance. Guitars, however, are somewhat singular in that the performer, during performance, often wishes to maneuver the instrument into positions other than the conventional front-of-the-body position.

Particularly in the field of rock music guitar players, it is quite common for guitarists to swing the guitar wildly about themselves, above their heads, and down near the floor or other supporting surface during the performance. With performances lasting up to several hours, holding the guitar in a playable position is extremely tiring and can cause sufficient fatigue in the performers' arms and hands as to reduce the performers' artistic abilities and speed. With no support for the guitar following these wild maneuvers, it becomes even more of a strain on the performer.

The prior art has attempted to provide support devices for relieving the arm strain from the performer by supporting the guitar and other stringed instruments through the use of belts or levers. Most of these prior art devices utilize straps that are passed over the shoulders, around the neck, or otherwise across the torso and terminate in clasps that may be attached to the stringed instrument to support it in front of the performer. However, they all share one common disadvantage.

Little thought has been given to providing the performer with the ability to carry on the wild gyrations of his/her body and of the stringed instruments, as is expected and common during personal performances, to allow the stringed instrument to be re-set or re-supported in the playing position, at the front of the performer's body, following cessation of these gyrations. Such an ability would allow the performer to continue playing the music without the stress and strain of continually supporting the instrument, or from interrupting their performance to reattach the guitar or other stringed instrument to the support structure.

Accordingly, a need remains for a guitar strap that overcomes the above-noted shortcomings.

BRIEF SUMMARY OF THE INVENTION

In view of the foregoing background, it is therefore an object of the present invention to provide a guitar strap to relieve neck and back pain. These and other objects, features, and advantages of the invention are provided by an apparatus securable about a waist of an operator for supporting a guitar at select positions.

The apparatus includes a belt that has a centrally disposed longitudinal axis and a pair of selectively engageable end portions extending substantially parallel thereto. The belt further has a central portion integral with the opposed end portions and is disposed substantially medially of an abdominal area of an operator. The belt preferably has a substantially planar front surface with the plurality of support members conveniently connected thereto and extending forwardly therefrom so that a guitar can be spaced forwardly from an operator.

The belt further includes a rear surface and a central layer sandwiched between the front and rear surfaces. The rear surface may be formed from a predetermined fabric, the central layer is preferably formed from a resilient material, and the front surface may be formed from leather. Of course, other conventional material may be employed without departing from the true scope of the invention.

The belt further has top and bottom edge portions with the plurality of support members respectively attached thereto so that one of the support members can conveniently support an upper portion of a guitar and another one of the support members can conveniently support a lower portion of a guitar.

The apparatus further includes a plurality of adjustable support members secured to the central portion and oppositely spaced from the axis. The plurality of support members include a plurality of hook sections connected thereto for receiving select portions of a guitar to thereby allow a user to advantageously maintain a guitar at a substantially stable position during operating conditions.

The plurality of support members may further include a plurality of brackets secured to the front surface of the belt respectively, a plurality of flexible straps have opposed end portions and a plurality of pins connected to one of such end portions thereof for attaching to the plurality of brackets respectively. The plurality of pins may be selectively rotated about the plurality of brackets respectively so that a guitar can advantageously be effectively maneuvered during operating conditions.

The present invention may further include a plurality of fastening members connected to another one of the end portions of the plurality of straps respectively. The plurality of straps preferably have a plurality of apertures formed therein with select ones of the plurality apertures being alignable for removably receiving the plurality of fastening members therethrough so that a length of the plurality of support members may be advantageously adjusted as desired by an operator.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
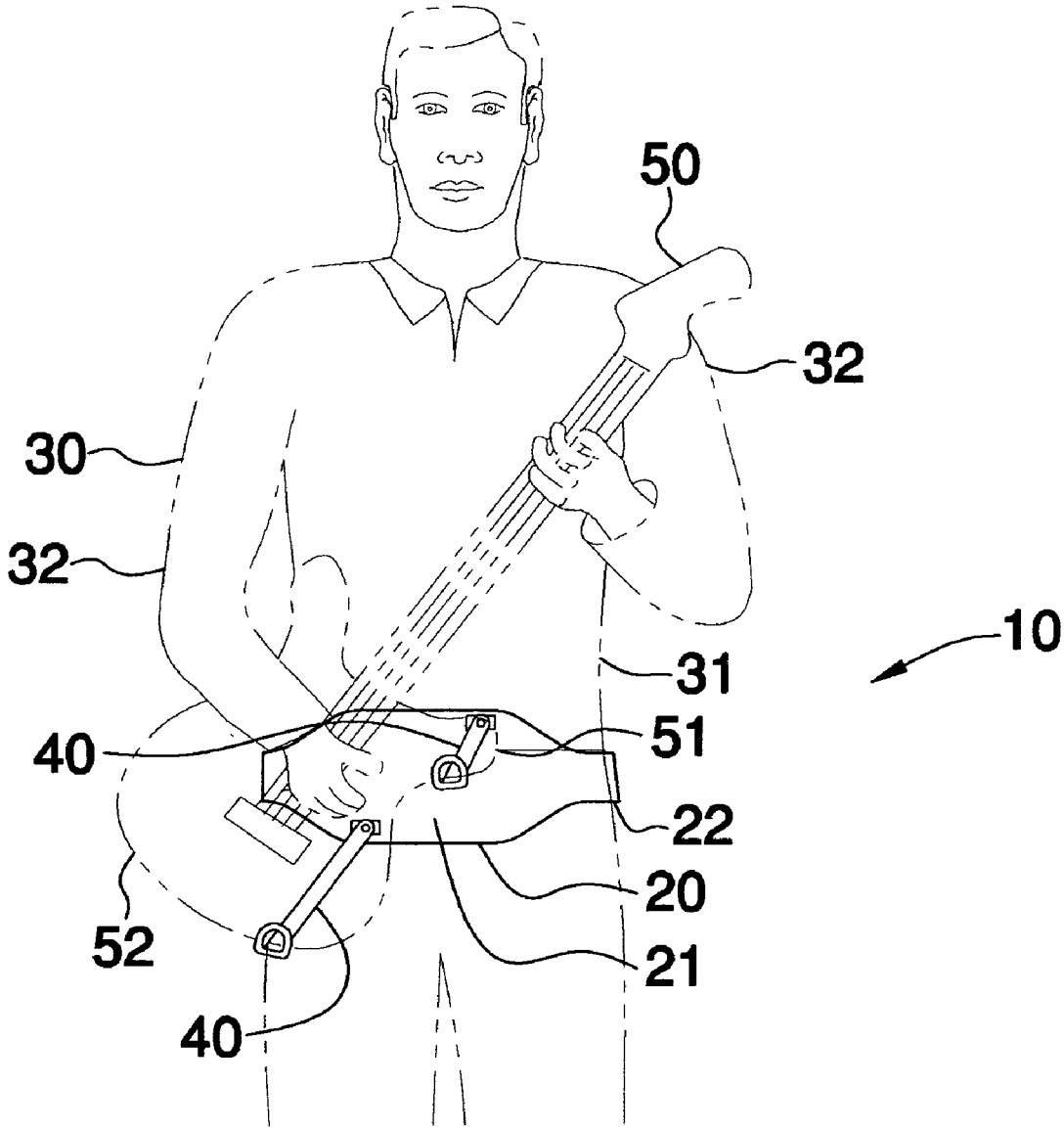
FIG. 1 is a front elevational view showing a guitar strap positioned about an operator's waist, in accordance with the present invention.
Figure 2:
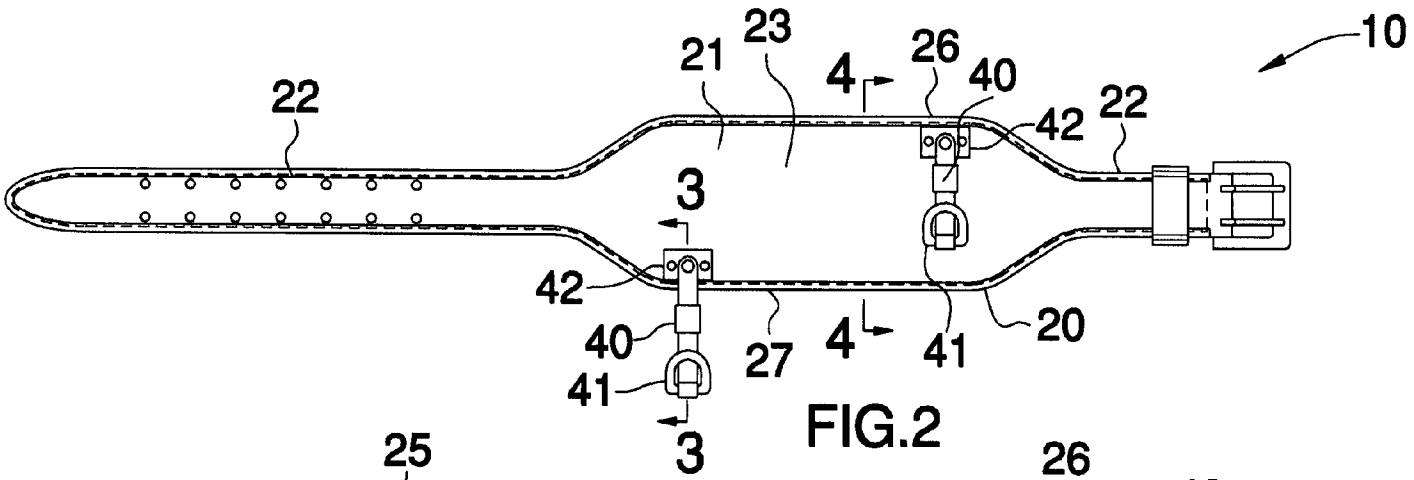
FIG. 2 is an enlarged front elevational view of the apparatus shown in FIG. 1.
Figure 4:
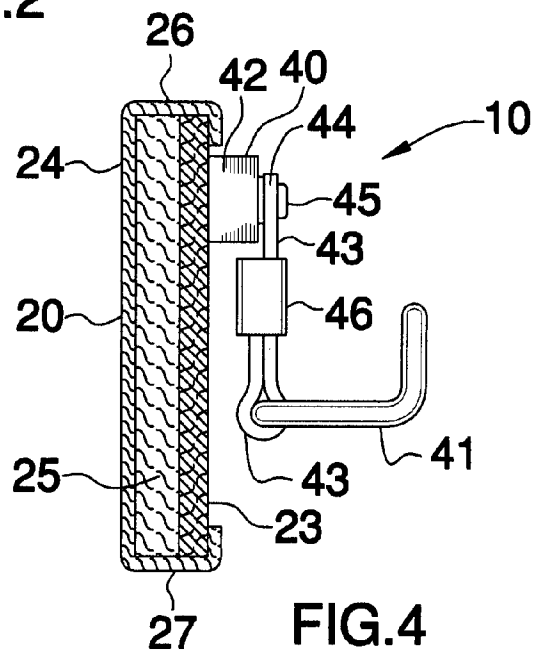
FIG. 4 is a cross-sectional view of the belt shown in FIG. 2 and taken along line 4—4.
Figure 3:
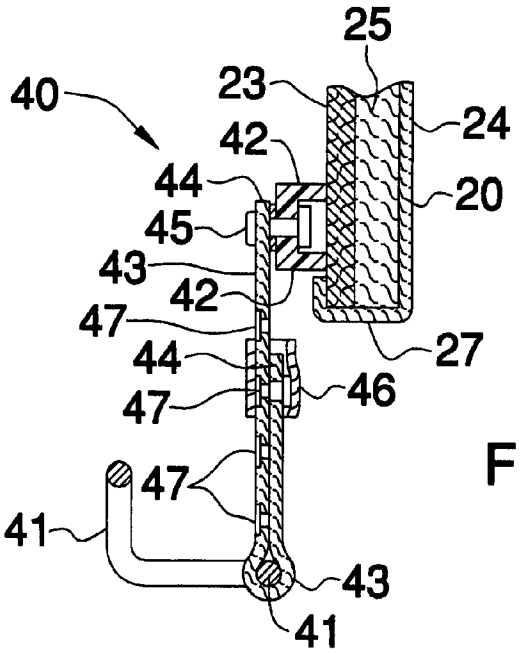
FIG. 3 is a cross-sectional view of a support member shown in FIG. 2 and taken along line 3—3.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide a guitar strap. It should be understood that the apparatus 10 may be used to support many different types of music instruments and should not be limited to only guitars.

Referring initially to FIG. 1, the apparatus 10 includes a belt 20 that has a centrally disposed longitudinal axis and a pair of selectively engageable end portions 22 extending substantially parallel thereto, advantageously allowing the belt 20 to be adjusted to operators of various sizes. The belt 20 further has a central portion 21 integral with the opposed end portions 22 and is disposed substantially medially of an abdominal area 31 of an operator 30. The belt 20 has a substantially planar front surface 23 with the plurality of support members 40 conveniently connected thereto and extending forwardly therefrom so that a guitar 50 can be spaced forwardly from an operator 30.

The belt 20 further includes a rear surface 24 and a central layer 25 sandwiched between the front 23 and rear surfaces 24. The rear surface 24 is formed from a predetermined fabric, the central layer 25 is formed from a resilient material, and the front surface 23 is formed from leather. The resilient central layer 25 provides structural integrity to the apparatus, while the fabric rear surface 24 provides comfort to the abdominal area 31 of an operator. Of course, other conventional materials may be employed without departing from the true scope of the invention.

The belt 20 further has top 26 and bottom 27 edge portions with the plurality of support members 40 respectively attached thereto so that one of the support members 40 can conveniently support an upper portion 51 of a guitar 50 and another one of the support members 40 can conveniently support a lower portion 52 of a guitar 50. The positioning of the support members 40 in such a manner allows for even distribution of the forces exerted on the belt 20 by a guitar 50 or other instruments (not shown), thereby eliminating strain focused on only one portion of the belt.

The apparatus 10 further includes a plurality of adjustable support members 40 secured to the central portion 21 and oppositely spaced from the axis. The plurality of support members 40 include a plurality of hook sections 41 connected thereto for receiving select portions of a guitar 50 to thereby allow a user to advantageously maintain a guitar 50 at a substantially stable position during operating conditions. The hook sections 41 absorb most of the gravitational force exerted upon the guitar 50, instead of the operator's 30 arms 32 and back.

The plurality of support members 40 further include a plurality of brackets 42 secured to the front surface 23 of the belt 20 respectively, a plurality of flexible straps 43 have opposed end portions 44 and a plurality of pins 45 connected to one of such end portions 44 thereof for attaching to the plurality of brackets 42 respectively. The plurality of pins 45 is selectively rotated about the plurality of brackets 42 respectively so that a guitar 50 can advantageously be effectively maneuvered during operating conditions.

The present invention further includes a plurality of fastening members 46 connected to another one of the end portions 44 of the plurality of straps 43 respectively. The plurality of straps 43 have a plurality of apertures 47 formed therein with select ones of the plurality apertures 47 being alignable for removably receiving the plurality of fastening members 46 therethrough so that a length of the plurality of support members 40 may be advantageously adjusted as desired by an operator 30. This feature allows the apparatus 10 to accommodate a plethora of guitars 50 available to operators of various skill levels and musical interests.

Other appealing features of the apparatus 10 are its convenience, ease of use, light weight design, freedom of movement, and the ability to reduce stress on an operator's 30 upper body, especially the lower back region. The waist worn design ultimately reduces the pain and discomfort caused by conventional shoulder worn guitar straps, by eliminating a strap digging into an operator's 30 upper body.

This is particularly appreciated with heavier guitars such as the Gibson and Les Paul models. In addition, the apparatus 10 allows an operator 30 virtually unrestricted movement in the arms 32 and upper body, and gives the eye-catching appearance of a mid-air suspended guitar. The apparatus 10 will not only be appreciated by professional performers who require mobility during their acts, but also by school marching bands and other such organizations.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

The invention claimed is:

1. An apparatus securable about a waist of an operator and for supporting a guitar at select positions, said apparatus comprising:

a belt having a centrally disposed longitudinal axis and a pair of selectively engageable end portions extending substantially parallel thereto, said belt further having a central portion integral with said opposed end portions and being disposed substantially medially of an abdominal area of an operator; and a plurality of adjustable support members secured to said central portion and being oppositely spaced from the axis, said plurality of support members comprising a plurality of hook sections connected thereto and for receiving select portions of a guitar to thereby allow a user to maintain a guitar at a substantially stable position during operating conditions;

wherein said plurality of support members further comprise a plurality of brackets secured to said front surface of said belt respectively, a plurality flexible straps having opposed end portions and a plurality of pins connected to one said opposed end portions thereof for attaching to said plurality of brackets respectively, said plurality of pins being selectively rotatable about said plurality of brackets respectively so that a guitar can be effectively maneuvered during operating conditions, and a plurality of fastening members connected to another said opposed end portions of said plurality of straps respectively, said plurality of straps having a plurality of apertures formed therein with select ones of said plurality apertures being alienable for removably receiving said plurality of fastening members therethrough so that a length of said plurality of support member can be adjusted as desired by an operator.

2. The apparatus of claim 1, wherein said belt has a substantially planar front surface with said plurality of support members being connected thereto and extending forwardly therefrom so that a guitar can be spaced forwardly from an operator.

3. The apparatus of claim 1, wherein said belt further has top and bottom edge portions with said plurality of support members being respectively attached thereto so that one said plurality of support members can support an upper portion of a guitar and another said plurality of support members can support a lower portion of a guitar.

4. The apparatus of claim 2, wherein said belt further comprises:

a rear surface and a central layer sandwiched between said front and rear surfaces.

5. The apparatus of claim 4, wherein said rear surface is formed from a predetermined fabric;

said central layer is formed from a resilient material; and said front surface is formed from leather.

6. An apparatus securable about a waist of an operator and for supporting a guitar at select positions, said apparatus comprising:

a belt having a centrally disposed longitudinal axis and a pair of selectively engageable end portions extending substantially parallel thereto, said belt further having a central portion integral with said opposed end portions and being disposed substantially medially of an abdominal area of an operator; and a plurality of adjustable support members secured to said central portion and being oppositely spaced from the axis, said plurality of support members comprising a plurality of hook sections connected thereto and for receiving select portions of a guitar to thereby allow a user to maintain a guitar at a substantially stable position during operating conditions, said plurality of support members further comprising a plurality of brackets secured to said front surface of said belt respectively, a plurality flexible straps having opposed end portions and a plurality of pins connected to one said opposed end portions thereof for attaching to said plurality of brackets respectively, said plurality of pins being selectively rotatable about said plurality of brackets respectively so that a guitar can be effectively maneuvered during operating conditions, and a plurality of fastening members connected to another said opposed end portions of said plurality of straps respectively, said plurality of straps having a plurality of apertures formed therein with select ones of said plurality apertures being alignable for removably receiving said plurality of fastening members therethrough so that a length of said plurality of support member can be adjusted as desired by an operator.

7. The apparatus of claim 6, wherein said belt has a substantially planar front surface with said plurality of support members being connected thereto and extending forwardly therefrom so that a guitar can be spaced forwardly from an operator.

8. The apparatus of claim 6, wherein said belt further has top and bottom edge portions with said plurality of support members being respectively attached thereto so that one said plurality of support members can support an upper portion of a guitar and another said plurality of support members can support a lower portion of a guitar.

9. The apparatus of claim 7, wherein said belt further comprises:

a rear surface and a central layer sandwiched between said front and rear surfaces.

10. The apparatus of claim 9, wherein said rear surface is formed from a predetermined fabric;

said central layer is formed from a resilient material; and said front surface is formed from leather.

11. An apparatus securable about a waist of an operator and for supporting a guitar at select positions, said apparatus comprising:

a belt having a centrally disposed longitudinal axis and a pair of selectively engageable end portions extending substantially parallel thereto, said belt further having a central portion integral with said opposed end portions and being disposed substantially medially of an abdominal area of an operator; and a plurality of adjustable support members secured to said central portion and being oppositely spaced from the axis, said plurality of support members comprising a plurality of hook sections connected thereto and for receiving select portions of a guitar to thereby allow a user to maintain a guitar at a substantially stable position during operating conditions, said plurality of support members further comprising a plurality of brackets secured to said front surface of said belt respectively, a plurality flexible straps having opposed end portions and a plurality of pins connected to one said opposed end portions thereof for attaching to said plurality of brackets respectively, said plurality of pins being selectively rotatable about said plurality of brackets respectively so that a guitar can be effectively maneuvered during operating conditions, and a plurality of fastening members connected to another said opposed end portions of said plurality of straps respectively, said plurality of straps having a plurality of apertures formed therein with select ones of said plurality apertures being alignable for removably receiving said plurality of fastening members therethrough so that a length of said plurality of support member can be adjusted as desired by an operator;

said belt having a substantially planar front surface with said plurality of support members being connected thereto and extending forwardly therefrom so that a guitar can be spaced forwardly from an operator.

12. The apparatus of claim 11, wherein said belt further has top and bottom edge portions with said plurality of support members being respectively attached thereto so that one said plurality of support members can support an upper portion of a guitar and another said plurality of support members can support a lower portion of a guitar.

13. The apparatus of claim 11, wherein said belt further comprises:

a rear surface and a central layer sandwiched between said front and rear surfaces.

14. The apparatus of claim 13, wherein said rear surface is formed from a predetermined fabric;

said central layer is formed from a resilient material; and said front surface is formed from leather.

* * * * *